United States Patent [19]

Durville

[11] 4,054,042

[45] Oct. 18, 1977

[54] APPARATUS FOR ACCELERATING A KNITTING NEEDLE DURING ITS STITCH DRAWING STROKE

[75] Inventor: Gerard Durville, Le Lignon, Switzerland

[73] Assignee: Battelle Memorial Institute, Geneve, Switzerland

[21] Appl. No.: 650,684

[22] Filed: Jan. 20, 1976

[30] Foreign Application Priority Data

Jan. 31, 1975 Switzerland ..... 1186/75

[51] Int. Cl.[2] ..... D04B 15/32

[52] U.S. Cl. ..... 66/57; 66/13; 66/123

[58] Field of Search ..... 66/57, 123, 107, 13, 66/50 R

[56] References Cited

U.S. PATENT DOCUMENTS

| | | | |
|---|---|---|---|
| 1,220,918 | 3/1917 | Wilcomb | 66/57 X |
| 1,291,226 | 1/1919 | Steed | 66/13 |
| 1,503,024 | 7/1924 | Chapatte | 66/123 X |
| 2,025,462 | 12/1935 | Lombardi | 66/50 R |
| 2,740,277 | 4/1956 | Lombardi | 66/50 R |
| 3,449,928 | 6/1969 | Schmidt et al. | 66/50 R |
| 3,500,662 | 3/1970 | Ribler | 66/50 R |
| 3,535,892 | 10/1970 | Schmidt et al. | 66/13 |
| 3,710,594 | 1/1973 | Bourgeois | 66/50 R |
| 3,863,465 | 2/1975 | De Cerjat et al. | 66/50 R |
| 3,877,255 | 4/1975 | Allavena | 66/123 X |
| 3,890,805 | 6/1975 | Bourgeois | 66/50 R |
| 3,902,335 | 9/1975 | Durville | 66/13 |

*Primary Examiner*—Mervin Stein
*Assistant Examiner*—Andrew M. Falik
*Attorney, Agent, or Firm*—Karl F. Ross

[57] ABSTRACT

A circular knitting machine comprises a needle cylinder, centered on a vertical axis, formed with a multiplicity of vertical guide grooves for respective knitting needles which have heels riding on an upper ramp surface formed by one or more lifting cams on a stationary support about which the cylinder rotates. A lower ramp surface acts upon the needles through respective hairpin springs, the two ramp surfaces diverging in the first part and converging in the second part of a descending cam section whereby a force stored in the springs at the beginning of a downstroke motion accelerates the descent of the needles toward the end of that stroke.

12 Claims, 6 Drawing Figures

APPARATUS FOR ACCELERATING A KNITTING NEEDLE DURING ITS STITCH DRAWING STROKE

FIELD OF THE INVENTION

My present invention relates to a knitting machine, e.g. one of the circular type as disclosed for example in my prior U.S. Pat. No. 3,902,335, wherein a needle carrier has a multiplicity of parallel channels for the guidance of respective knitting needles which are reciprocable — usually in a vertical direction — under the control of cam means carried on a support, the needle carrier and the support being relatively movable whereby successive needles undergo identical forward and return strokes.

BACKGROUND OF THE INVENTION

Two separate ramp surfaces formed by the cam means are generally provided in such machines for the purpose of respectively displacing the needles in a forward stroke (hereinafter assumed to be upward) and in a return stroke (hereinafter assumed to be donward). The first ramp surface elevates the needles in the first part of a stitch-forming cycle to let their hooks engage a new length of thread to be drawn into a loop during the subsequent downstroke controlled by the second ramp surface. This downstroke should be as fast as possible, not only in order to shorten the overall stitch-forming cycle but also to provide a more effective staggering between the pull-down operations of adjoining needles simultaneously engaging the same thread for the purpose of reducing the number of friction points between the thread and these needles. On the other hand, such an acceleration of the downstroke in a conventional knitting machine would require an increase in the slope of the second or needle-lowering ramp surface with resulting augmentation of the shear stresses exerted by the cam upon each needle.

OBJECT OF THE INVENTION

The object of my present invention, therefore, is to provide an improved needle-control system in such a knitting machine which enables the acceleration of the downstroke without significantly increasing the shear stresses.

SUMMARY OF THE INVENTION

I accomplish this object, in accordance with my present invention, by the provision of cam-follower means individual to each needle engaging the aforementioned second (needle-lowering) ramp surface, the cam-follower means being coupled with the respective needle by resilient link means such as a hairpin spring designed to store a needle-retracting force during an initial phase and to release the stored force during a terminal phase of the return stroke; the first ramp surface, engaging a heel of each oncoming needle, diverges from the second ramp surface, in one part of a cam section effective during the initial phase, for stressing the resilient means, and converges with the second ramp surface, in another part of the cam section effective during the terminal phase, for relaxing the resilient means whereby the stored force is transferred to the respective needle for accelerating its return motion.

The use of a hairpin spring for the purpose described is particularly advantageous since it enables the storage of a relatively large force in a plane generally perpendicular to the ramp surfaces, in line with the respective guide channel, thus avoiding any risk of interference between the control mechanisms of adjoining needles. Such a hairpin spring can be stressed in either of two ways, with its legs either compressed or spread apart by the stressing motion. In the first instance the two ramp surfaces may form part of a single cam member whereas in the second instance the spring is bracketed by two cam members, the latter arrangement also facilitating a change in the spacing of the two ramp surfaces (and therefore of the stress imparted to the spring) by an independently adjustable mounting of these cam members on their support.

BRIEF DESCRIPTION OF THE DRAWING

The above and other features of my invention will now be described in detail with reference to the accompanying drawing in which.

SPECIFIC DESCRIPTION

Figure 1:
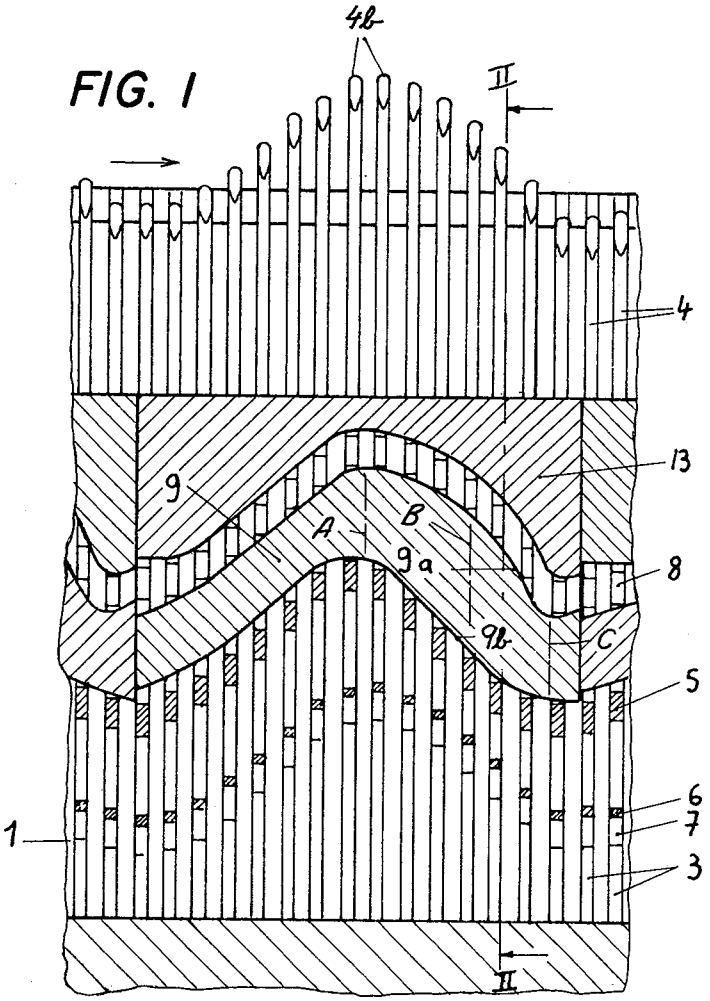
FIG. 1 is a partial developed view of a cylindrical needle carrier in a circular knitting machine according to my invention. taken on the line I — I of FIG. 2.
Figure 2:
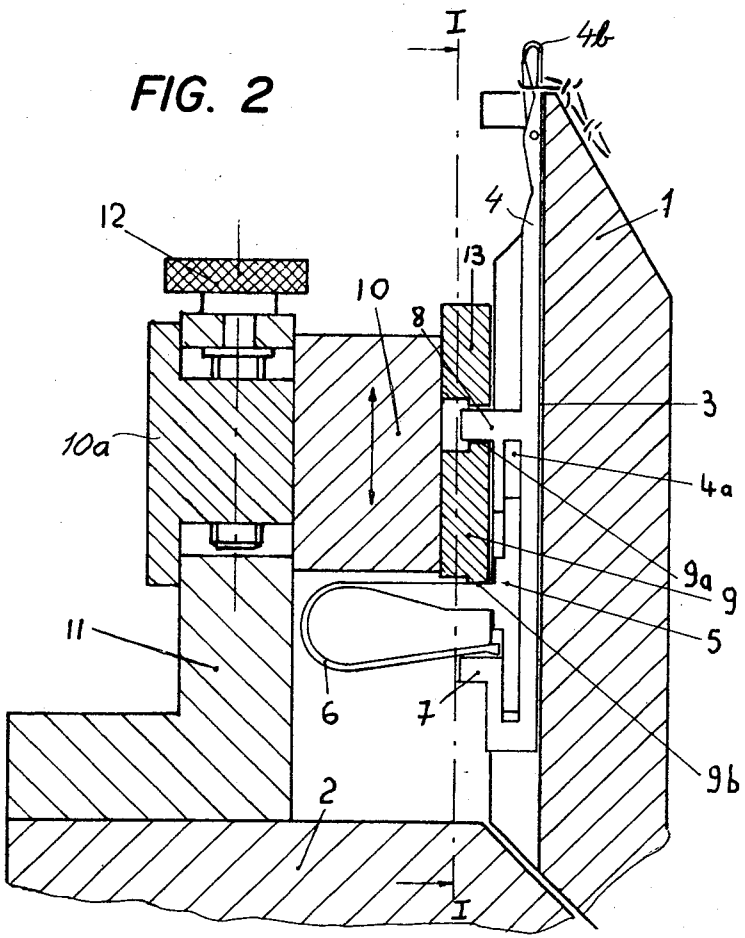
FIG. 2 is a fragmentary cross-sectional view taken on the line II — II of FIG. 1.

In FIGS. 1 and 2 I have shown a circular knitting machine comprising a cylindrical needle carrier 1 rotatable, by nonillustrated drive means, about a stationary central base 2. The inner peripheral surface of cylinder 1 is formed with a multiplicity of closely spaced vertical guide grooves or channels 3 accommodating respective needles 4 whose tips are formed into thread-engaging hooks **4*b* provided with latches in a manner well known per se, e.g. as disclosed in my aforementioned U.S. Pat. No. 3,902,335. As the cylinder 1 rotates, the needle hooks 4*b* are alternately raised above its upper edge and retracted below that edge in a generally sinusoidal motion under the control of a cam structure comprising a support 11 rigid with base 2, a set of mounting blocks 10 arrayed around the cylinder axis, and a plurality of indentical primary cams 9 and secondary cams 13 in the form of complementary ring segments mounted on the respective blocks 10. Each primary cam 9 forms an upper ramp surface 9*a* (facing in the direction of the needle hooks 4*b*) and a lower ramp surface 9*b* (facing away from those hooks) for the guidance of the needles 4 successively passing the corresponding section of the cam structure, all these sections being identical in order to reciprocate the needles through a plurality of stitch-forming cycles during each revolution of the carrier cylinder 1.**

The shank of each needle 4 is formed with a heel 8, resting on ramp surface **9*a*, and with a recess 4*a* acommodating a slide 5 which is limitedly vertically displaceable therein between the sidewalls of the associated guide channel or groove 3. The slide 5 is rigid with the upper leg of a hairpin spring 6 whose light portion projecting projects radially inwardly into the space below block 10, the lower leg of this spring bearing upon a lug 7 integral with needle 4. Each block 10 has an inward extension 10*a* traversed by an adjusting screw 12 which may be manually rotated to raise or lower the block 10 with its cams 9 and 13 relatively to the support 11; this adjustment does not change the length of the needle stroke, which is determined by the shape of the ramp surfaces 9*a* and 9*b*, but jointly varies the levels of the upper and lower stroke limits with reference to cylinder 1** whereby the length of a thread loop pulled down by the descending needle can be varied, it being understood that the thread or yarn is fed to the needles through a stationary guide structure as diagrammatically illustrated in my prior U.S. Pat. No. 3,902,335.

Figure 3:
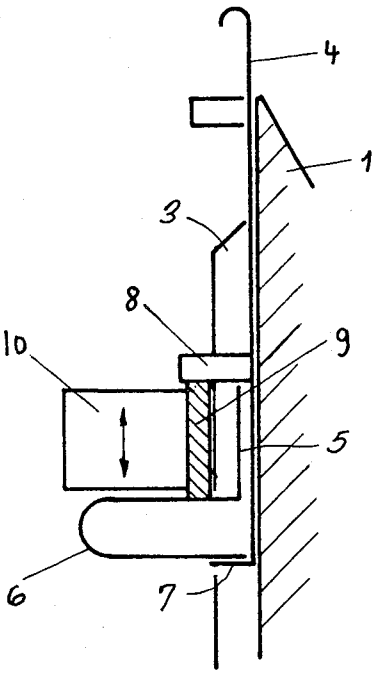

The secondary cam 13, whose lower edge parallels the upper ramp surface 9*a* of primary cam 9, does not have any needle-shifting function but merely serves to hold the heel 8 in contact with that ramp surface, thus guarding against an upward rebound of the needle whose downstroke is controlled by the ramp surface 9*b* in a nonpositive manner through the intermediary of spring 6. The guard cam 13 could also be omitted, as illustrated schematically in FIG. 3.

From FIG. 1 it will be apparent that the two ramps 9*a* and 9*b* are substantially parallel in their ascending section, i.e. in the left-hand half of cam 9 as viewed in this Figure, but that they diverge from each other in the first portion of the right-hand half of the cam (between lines A and B) while converging thereafter (between lines B and C). Thus, the slope of ramp surface 9*a* is less than that of ramp surface 9*b* in the stretch A – B but greater than that of surface 9*b* in the stretch B – C. As a result, the legs of spring 6 are compressed between cam 9 and lug 7 in the stretch A – B so that the spring stores a force which accelerates the descent of the needle in the stretch B – C in which such acceleration becomes possible by virtue of the increased slope of ramp surface 9*a*. It should be noted that this steep part of surface 9*a* does not exert any camming action upon heel 8 and therefore does not give rise to increased shear stresses.

Figure 4:
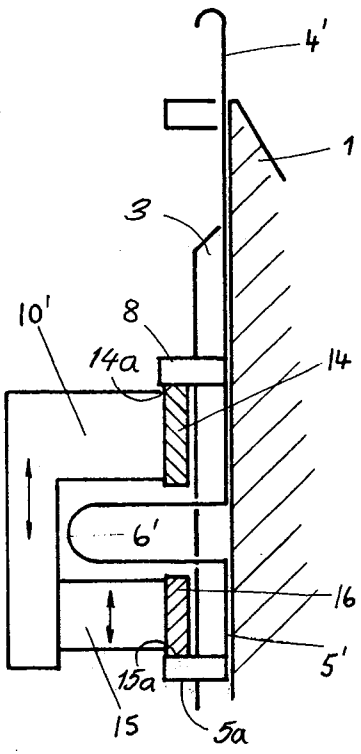

FIG. 4 shows a block 10' integral with a main cam 14 and provided with an ancillary cam 15 which is adjustably mounted thereon. A first ramp surface 14*a*, supporting the heel 8 of a needle 4', is here again formed by the primary cam 14 whereas a second ramp surface 15*a* forms part of ancillary cam 15, the letter surface bearing on a lug 5*a* which is rigid with a slide 5' vertically spaced from the lower end of needle 4'. Spring 6' is here shown as having its two legs integral with needle 4' and slide 5', respectively, these legs being spread apart in the stressing zone A – B (FIG. 1) in which the heel 8 is increasingly separated from the lug 5*a* by the diverging ramp surfaces. In the relaxation zone B – C, the needle 4' is again accelerated downwardly by the force stored in hairpin spring 6'.

Figure 5:
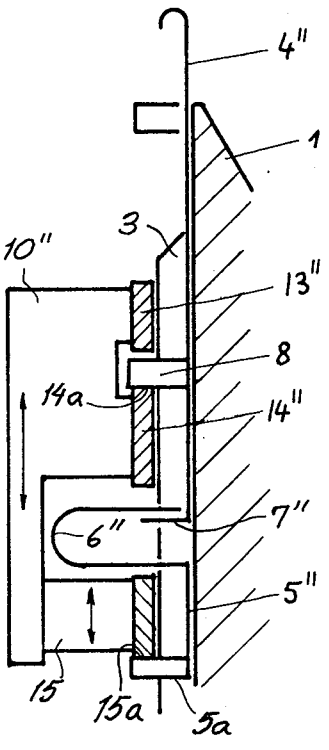

The arrangement of FIG. 5 differs from that of FIG. 4 by the fact that a needle 4'' has a lug 7'' on which the upper leg of a hairpin spring 6'' comes to rest, its lower leg being again integral with a slide 5'' guided in needle groove 3. There is also provided a guard cam 13'' mounted on the holder 10'' of main cam 14''.

Figure 6:
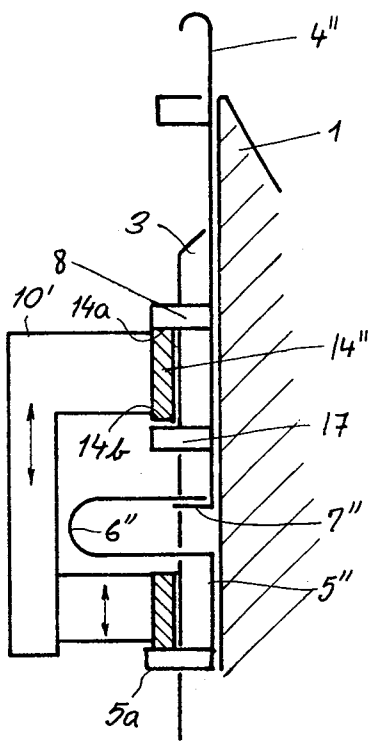
FIGS. 3 - 6 are highly diagrammatic views generally similar to FIG. 2, illustrating several modifications.

FIG. 6, finally, shows an arrangement generally similar to that of FIG. 5, except for the omission of the guard cam 13'' and its replacement by a second heel 17 of needle 4'' engaging the lower edge 14*b* of cam 14''. In this instance the two cam edges 14*a* and 14*b* must closely parallel each other, edge 14*b* having only a guard function in serving to prevent any upward rebound.

I claim:

1. A knitting machine comprising:

a needle carrier formed with a multiplicity of parallel guide channels;

a support provided with cam means forming a first and a second ramp surface, said support and said needle carrier being relatively movable in a direction substantially transverse to said guide channels;

a multiplicity of knitting needles respectively received in said guide channels for longitudinal displacement therein under the control of said cam means, each of said needles being provided with a heel engaging said first ramp surface and with a hook for drawing a thread into loops to form a succession of stitches, said first ramp surface being effective to advance each needle in a forward stroke of a stitch-forming cycle;

a slide individual to each needle limitedly movable in the assoicated guide channel and engaging said second ramp surface; and resilient link means individual to each needle coupling the respective slide with the respective needle for retracting the latter in a return stroke of a stitch-forming cycle, said resilient link means storing a needle-retracting force during an initial phase of said return strokes and releasing the stored force during a terminal phase of said return stroke with resulting acceleration of the needle, said first and second ramp surfaces diverging from each other in one part of a cam section, effective during said initial phase, for stressing said resilient link means and converging toward each other in another part of said cam section, effective during said terminal phase, for relaxing said link means.

2. A knitting machine as defined in claim 1 wherein said resilient link means comprises a hairpin spring with a bight portion projecting radially inwardly from said channel.

3. A knitting machine comprising:

a needle carrier formed with a multiplicity of parallel guide channels;

a support provided with cam means forming a first and a second ramp surface, said support and said needle carrier being relatively movable in a direction substantially transverse to said guide channels;

a multiplicity of knitting needles respectively received in said guide channels for longitudinal displacement therein under the control of said cam means, each of said needles being provided with a heel engaging said first ramp surface and with a hook for drawing a thread into loops to form a succession of stitches, said first ramp surface facing in the direction of said hook and being effective to advance each needle in a forward stroke of a stitch-forming cycle;

cam-follower means individual to each needle but movable independently thereof, said cam-follower means engaging said second ramp surface for retracting the respective needle in a return stroke of a stitch-forming cycle, said second ramp surface facing in a direction away from said hook; and resilient link means coupling said cam-follower means with the respective needle for storing a needle-retracting force during an initial phase of said return stroke and releasing the stored force during a terminal phase of said return stroke with resulting acceleration of the needle, said first and second ramp surfaces diverging from each other in one part of a cam section, effective during said initial phase, for stressing said resilient means and converging toward each other in another part of said cam section, effective during said terminal phase, for relaxing said resilient means.

4. A knitting machine as defined in claim 1 wherein said guide channels are vertical and said needles move upwardly in said forward stroke, said first ramp surface lying above said second ramp surface and descending less steeply than said second ramp surface on said one part and more steeply than said second ramp surface on said other part of said cam section.

5. A knitting machine as defined in claim 1 wherein said resilient means comprises a hairpin spring.

6. A knitting machine as defined in claim 5, further comprising a multiplicity of slides limitedly movable in said guide channels, said hairpin spring having one leg operatively connected with the respective needle and another leg operatively connected with the respective slide.

7. A knitting machine as defined in claim 6 wherein each needle has a shank disposed in the respective guide channel and formed with a recess adjoining said heel, each of said slides being received in said recess of the respective needle, said second ramp surface bearing upon said other leg for compressing said hairpin spring during said initial phase.

8. A knitting machine as defined in claim 6 wherein said cam means comprises a main cam forming said first ramp surface and an ancillary cam forming said second ramp surface, said slide having an extension engaged by said second ramp surface for spreading said hairpin spring during said initial phase, said hairpin spring projecting between said main and ancillary cams.

9. A knitting machine as defined in claim 6 wherein said main and ancillary cams are independently adjustable on said support in a direction parallel to said guide channels.

10. A knitting machine as defined in claim 1, further comprising guard means on said support coacting with each needle for holding said heel close to said first ramp surface throughout a stitch-forming cycle.

11. A knitting machine as defined in claim 8 wherein said guard means comprises an additional cam in contact with said heel.

12. A knitting machine as defined in claim 8 wherein said guard means comprises a needle extension engaging a surface of said cam means paralleling said first ramp surface.

* * * * *